United States Patent [19]

Booth et al.

[11] 4,140,229

[45] Feb. 20, 1979

[54] COAL CUTTER VEHICLE

[75] Inventors: Walter G. Booth, Burford Township, Brant County; Charles D. Pole, Roxboro, both of Canada

[73] Assignee: Timberland Equipment Limited, Woodstock, Canada

[21] Appl. No.: 790,032

[22] Filed: Apr. 22, 1977

[30] Foreign Application Priority Data

Mar. 1, 1977 [CA] Canada ..... 272940

[51] Int. Cl.[2] ..... B65G 65/42

[52] U.S. Cl. ..... 214/17 DA; 214/83.14; 214/DIG. 2; 214/15 R; 299/74

[58] Field of Search ..... 214/17 DB, 17 D, 17 DC, 214/15 R, 15 C, 15 D, 83.14, 520, DIG. 2; 299/73, 74, 71; 222/226; 198/515

[56] References Cited

U.S. PATENT DOCUMENTS

| | | | |
|---|---|---|---|
| 2,746,617 | 5/1956 | Borrowdale | 214/17 DA |
| 3,212,652 | 10/1965 | Roberts | 214/17 DA |
| 3,232,457 | 2/1966 | Bernstein et al. | 214/17 DA |
| 3,550,961 | 12/1970 | Hughes | 299/71 |

*Primary Examiner*—Albert J. Makay

*Attorney, Agent, or Firm*—Stevens, Davis, Miller & Mosher

[57] ABSTRACT

A reclaimer apparatus is positioned in an elongated bulk material containing hopper or cargo hold of the type having opposed side walls which slope downwardly and inwardly toward the hopper bottom, the latter having a series of longitudinally extending discharge openings therein for discharging the bulk material on to a conveyor running lengthwise of the hopper. The reclaimer apparatus includes a rigid frame adapted to be located above the discharge openings and means for propelling the frame along the hopper bottom. The reclaimer has cutters thereon adapted to cut through bulk material, such as coal, in planes lying generally parallel to and adjacent the sloping side walls whereby to undercut the bulk mateial and to cause same to cascade downwardly and along the side walls and through the discharge openings.

20 Claims, 16 Drawing Figures

COAL CUTTER VEHICLE

BACKGROUND OF THE INVENTION

This invention relates to the handling of bulk materials and particularly to the unloading of bulk materials, such as coal, from the storage hopper or hoppers of a vessel.

The prior art has provided a variety of types of self-unloading cargo vessels for carrying bulk materials such as coal, ore, sand and gravel etc. These vessels are usually designed with the hull of the vessel being partitioned by bulkheads into a number of cargo holds, the latter being essentially large storage hoppers, the lower portions of which are generally of V-shaped cross-section, such hoppers usually extending substantially the full length of the vessel. A series of hopper gates are located at the bottoms of these storage hoppers, which gates open over one or more unloading belt-type conveyors which serve to convey the bulk material to additional equipment which transfers the bulk material to a location outside the vessel.

A serious problem with certain types of bulk materials, especially Western Canadian coal, is that they often tend to "bridge" over the openings of the conventional hopper discharge gates i.e. there is a tendency for the bulk material to "hang up" and form itself into a self-supporting arch over the hopper gate openings thus preventing the material stored above the arch from being discharged. Alternatively, the material can form a vertical wall both transversely and longitudinally of the hopper i.e. the material may fall, by gravity, over the gate and to one side of the hopper, leaving a longitudinal face on the other side which must be undermined in order to make it cascade into the hopper.

One rather primitive way of dealing with the above noted problem is to send one or more men into the hopper with picks and shovels in order that they can manually break up the "bridge" and allow the material to fall by gravity onto the moving conveyor. However, this approach is unsatisfactory in that there is a serious danger of the bridge or arch of material suddenly collapsing and carrying the men who are working on it down into the discharge opening. Thus, this approach involves a substantial degree of risk and personnel have been badly injured and in some cases killed, as a result of having used this particular approach.

In an effort to eliminate the above noted problem, various devices have been provided by the prior art as shown for example in Canadian Pat. No. 564,070 issued Sept. 30, 1958 to Borrowdale, Canadian Pat. No. 857,706 issued Dec. 8, 1970 to Martini et al and U.S. Pat. No. 3,604,578 issued Sept. 14, 1971 to Smith. The first one of the above noted patents incorporates apparatus which may travel beneath the hopper and extend upwardly into the material in the hopper through the hopper bottom, the device being rotated in an effort to agitate the material in the hopper so as to break up any adhering or cohering condition which may exist thereby inducing the material to flow by gravity from the hopper. The second patent noted above includes a feeder which includes two rotary plow mechanisms for reclaiming bulk material from two inclined storage shelves located at the bottom of the vessel storage area. The last patent noted above incorporates inflatable means on the sloping hopper walls which means can be inflated and deflated thereby to loosen the bulk commodity thus reducing the tendency for "bridges" to form over the discharge opening.

The above noted patents are exemplary only of the various arrangements provided by the prior art. These and other prior art devices do not appear to have found wide acceptance, at least in vessels being operated on the Great Lakes of North America, possibly because they were not found to be as effective as intended and/or because they required costly modifications to the vessel structure or alternatively, different designs of hopper arrangements for the vessels were required.

SUMMARY OF THE INVENTION

It is thus a general object of the invention to provide improved method and apparatus for facilitating rapid and efficient unloading of the storage hoppers of a vessel or the like.

Thus, in accordance with the invention in one aspect there is provided in combination, an elongated hopper having downwardly and inwardly sloping side walls, the hopper having elongated discharge openings at its bottom, and conveyor means located below the discharge openings for conveying away bulk material discharging through said openings, and a reclaimer movable longitudinally of the hopper along said side walls adjacent the bottom of the hopper and above the discharge openings, said reclaimer having cutter means thereon for cutting said bulk material so as to undercut the bulk material and to cause same to cascade downwardly along the sloping side walls and through the elongated discharge openings.

A notable feature of the invention is that it is arranged to cut the bulk material away in planes lying generally parallel to and adjacent to the sloping side walls of the hopper. By undercutting the bulk material in this fashion, the same is caused to cascade downwardly and through the discharge openings.

In accordance with a further aspect of the invention there is provided reclaimer apparatus adapted to be positioned in an elongated bulk material containing hopper or cargo hold of the type having opposed side walls which slope downwardly and inwardly toward the hopper bottom, the latter having a series of longitudinally extending discharge openings therein for discharging the bulk material on to a conveyor running lengthwise of the hopper, said reclaimer apparatus comprising a generally rigid frame adapted to be located above said discharge openings, means for propelling said frame along the hopper bottom, the reclaimer including cutter means thereon adapted to cut through said bulk material in such a way as to undercut the bulk material and to cause same to cascade downwardly and along the side walls and through the discharge openings.

In one important aspect the reclaimer is arranged such that the cutter means can cut the bulk material away in planes lying generally parallel to and adjacent said sloping side walls.

In accordance with a further aspect of the invention the reclaimer has arm means thereon movable in said planes with the cutter means comprising rotatable cutter elements mounted on end portions of the arm means for undercutting the bulk material.

In accordance with a further aspect of the invention the reclaimer includes a body or frame portion with the arm means being pivotally mounted thereto. Actuator means serve to pivot the arms in planes generally parallel to the sloping side walls of the bins. In a preferred form of the invention, the arms are also extensible and retractable with actuator means being provided for extending and retracting the arms thereby enabling the cutter elements to traverse relatively large areas lying in the planes parallel to the sloping side walls. In addition, by making the arms such that they can be varied in length, the operator of the machine can extend the arms when moving into a "bridge" of bulk material thereby to position the cutter head as far away from the body of the reclaimer as possible during the initial stages so that as the bulk material cascades downwardly, the body of the machine is not likely to be buried. In the event that the cutter means should jam and thus cease rotation, the arms may be retracted to allow the cutter heads to clear themselves. The retractable arm feature also enables the reclaimer as a whole to be stored in a minimum amount of storage space. It has to be kept in mind that an extra foot of storage space requirement means many tons of lost pay load in the average vessel.

Drive means are provided for moving the reclaimer longitudinally of the hopper. In a preferred embodiment, the bottom portion of the hopper is provided with a gear-rack-like arrangement with the reclaimer per se being provided with a cog gear arrangement which cooperates with the gear-rack to positively move the reclaimer. The cog gear may be powered by a hydraulic motor or the like. Preferably, the powered cog gear arrangement is free to move vertically relative to the frame portion of the reclaimer thereby to eliminate disengagement of the cog gear from the gear-rack in the event the reclaimer is lifted upwardly momentarily by virtue of its travelling over certain of the bulk material which perchance has remained on the sloping side walls of the hopper.

The above noted gear-rack also preferably includes a track for guiding the reclaimer longitudinally of the hopper. The reclaimer may include guide rollers which cooperate with the track to positively guide the reclaimer for straight line movement along the hopper bottom.

The reclaimer is provided with several wheels which engage with the lower portions of the sloping side walls thereby rollingly supporting the reclaimer from movement along the hopper. The wheels are preferably splayed outwardly such that they lie in planes normal to the sloping side walls of the hopper. This provides for greater stability and more suitable distribution of stresses on the wheels and tires (if any).

The reclaimer may include a suitable shroud or cover having downwardly sloping walls so that when bulk material falls thereon, it will not interfere with the various operating components but rather will cascade downwardly and outwardly relative to the reclaimer. Suitable plow or scraper means may be provided adjacent the front of the reclaimer to clear away loose material which might impede movement of the reclaimer along the hopper bottom.

The various components of the reclaimer are preferably actuated by means of suitable forms of hydraulic actuators driven from hydraulic pumps which, in turn, are driven by an electric motor. This motor is supplied with power by means of an elongated power cable which is connected to a power cable take-up reel mounted to the reclaimer frame. The various hydraulic actuators, hydraulic motors, etc., are preferably controlled by means of electrically controlled circuits which serve to actuate suitable solenoid valves provided in the various hydraulic circuits. These controls may be mounted in a detachable control console which is connected to the reclaimer body by means of a length of control cable thus enabling the operator to remain a substantial distance away from the reclaimer while operating same thus reducing the possibility of the operator being injured by avalanches of bulk material. However, it has been found for most purposes that the control console may be mounted directly on the rear of the reclaimer with the reclaimer also having an operator's station, including a seat, mounted thereon.

The method aspect of the invention includes the steps of providing a reclaimer capable of travelling along the the hopper above the discharge gates, allowing bulk material to pass through one or more of the discharge gates and, in any case where the bulk material tends to form a bridge over the discharge gate to thus prevent or inhibit the flow of the bulk material therethrough, advancing said reclaimer to the region of the bridge of material and then cutting away a layer of the bulk material in a plane (or planes) generally parallel to one (or both) of the sloping side walls to undermine the bulk material and to cause it to cascade downwardly and through the discharge openings.

BRIEF DESCRIPTION OF THE DRAWINGS

A typical embodiment of the invention will now be described by way of example with reference being had to the accompanying drawings in which.

DETAILED DESCRIPTION

Figures 1, 2:
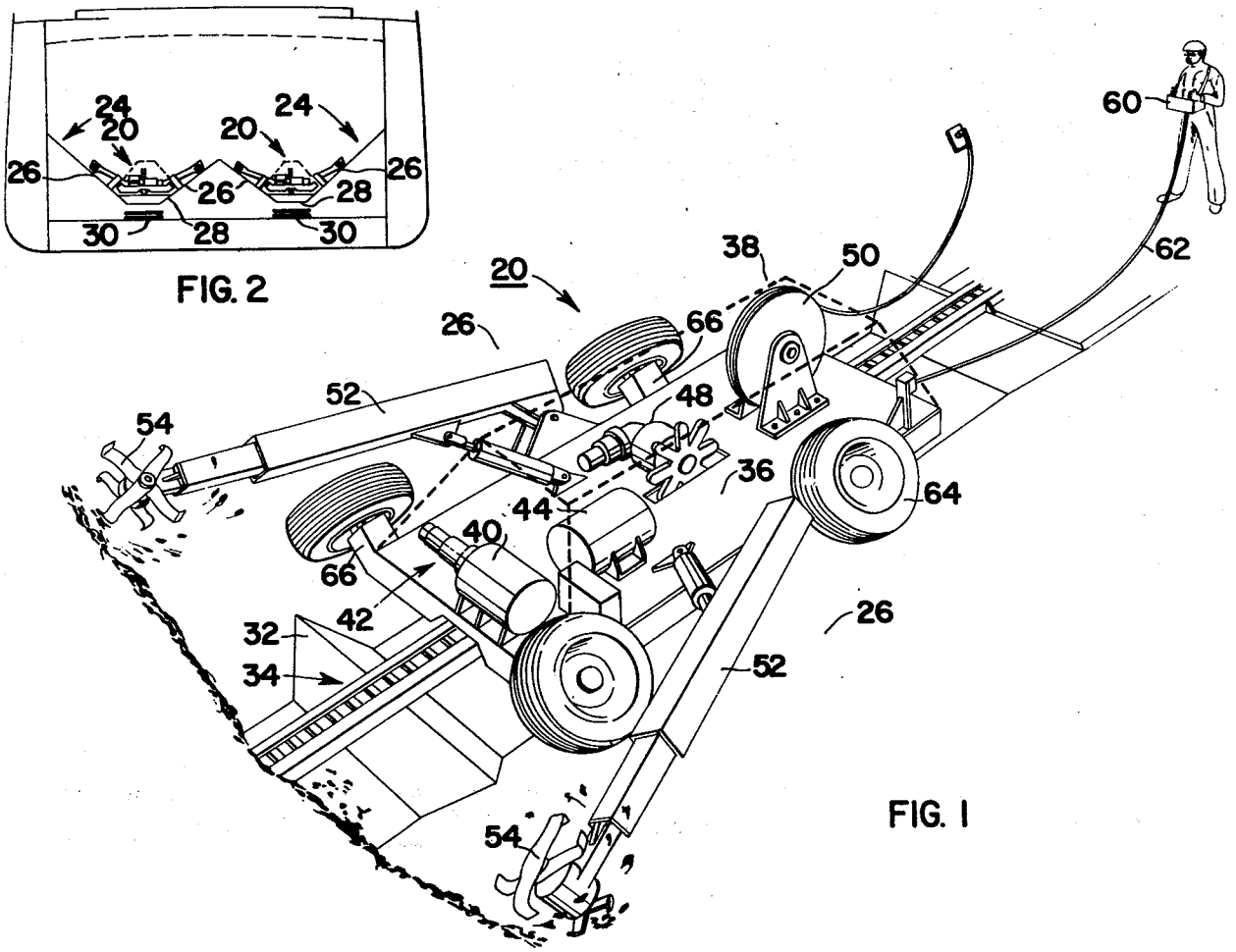
FIG. 1 is a perspective view of a reclaimer in accordance with the invention, the protective shroud being removed and certain of the other components being removed and/or shown in simplified form for purposes of clarity.
FIG. 2 is a somewhat simplified transverse section view of the hold of a vessel showing how the reclaimers are positioned when in use.

With reference now to the drawings, FIG. 1 is a perspective view of a reclaimer 20 in accordance with the invention, the reclaimer being shown in somewhat simplified form with the protective shroud or cover 38 therefor being shown in phantom and certain of the other components either being removed and/or shown in simplified form for purposes of clarity. FIG. 2, as noted above, is a somewhat diagrammatic transverse section view of a hold of a vessel showing how the reclaimers 20 are positioned when in use. In FIG. 2, the hold of the vessel is shown as containing two longitudinally extending hoppers adjacent the lower portion of the cargo carrying hold such hoppers extending longitudinally of the vessel. Each of these hoppers 24 includes downwardly sloping side walls 26, the side walls 26 sloping downwardly and inwardly toward one another with each hopper having a plurality of elongated discharge openings 28 at its bottom. Belt conveyor systems 30 extend longitudinally of the vessel below the discharge openings 28 for receiving and conveying away bulk material which has been discharged through openings 28. The conveyor systems 30 cooperate with additional means (not shown) for conveying the bulk material upwardly and out of the vessel and away to another location. As is well known in the art, the discharge openings 28 are provided with movable gates which may be opened when desired thereby to effect flow of the material downwardly by virtue of gravity and on to the conveyor belt systems 30.

The hold of the vessel may also be provided with transversely extending bulkheads (not shown), the lower portions of which are provided with access ports thereby to permit the reclaimer 20 to travel therethrough.

The above noted discharge gates 28 are separated from one another by transverse sections 32 of generally inverted V-shape configuration, which sections 32 are welded to the lower portions of the side walls 26 with such sections 32 being spaced apart from one another at equal distances longitudinally of the vessel. These sections 32 serve to support a combined track and rack arrangement 34 which forms a part of the means for guiding and moving the reclaimer longitudinally of the vessel and it will be described in further detail hereinafter.

Figure 3:
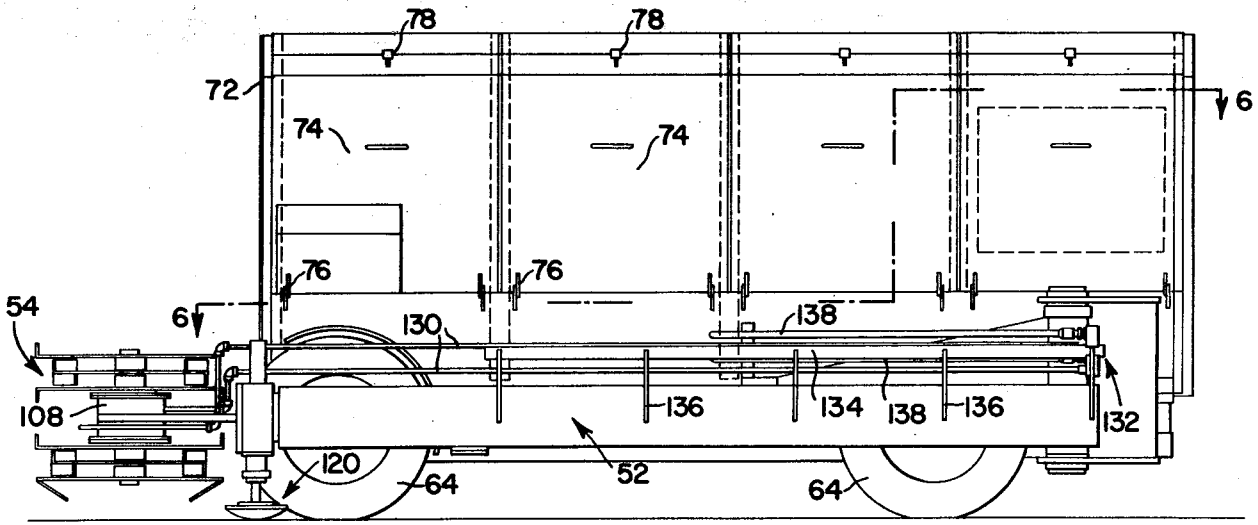
FIG. 3 is an oblique side view of the reclaimer looking in the direction of arrow 3 in FIG. 4.
Figure 4:
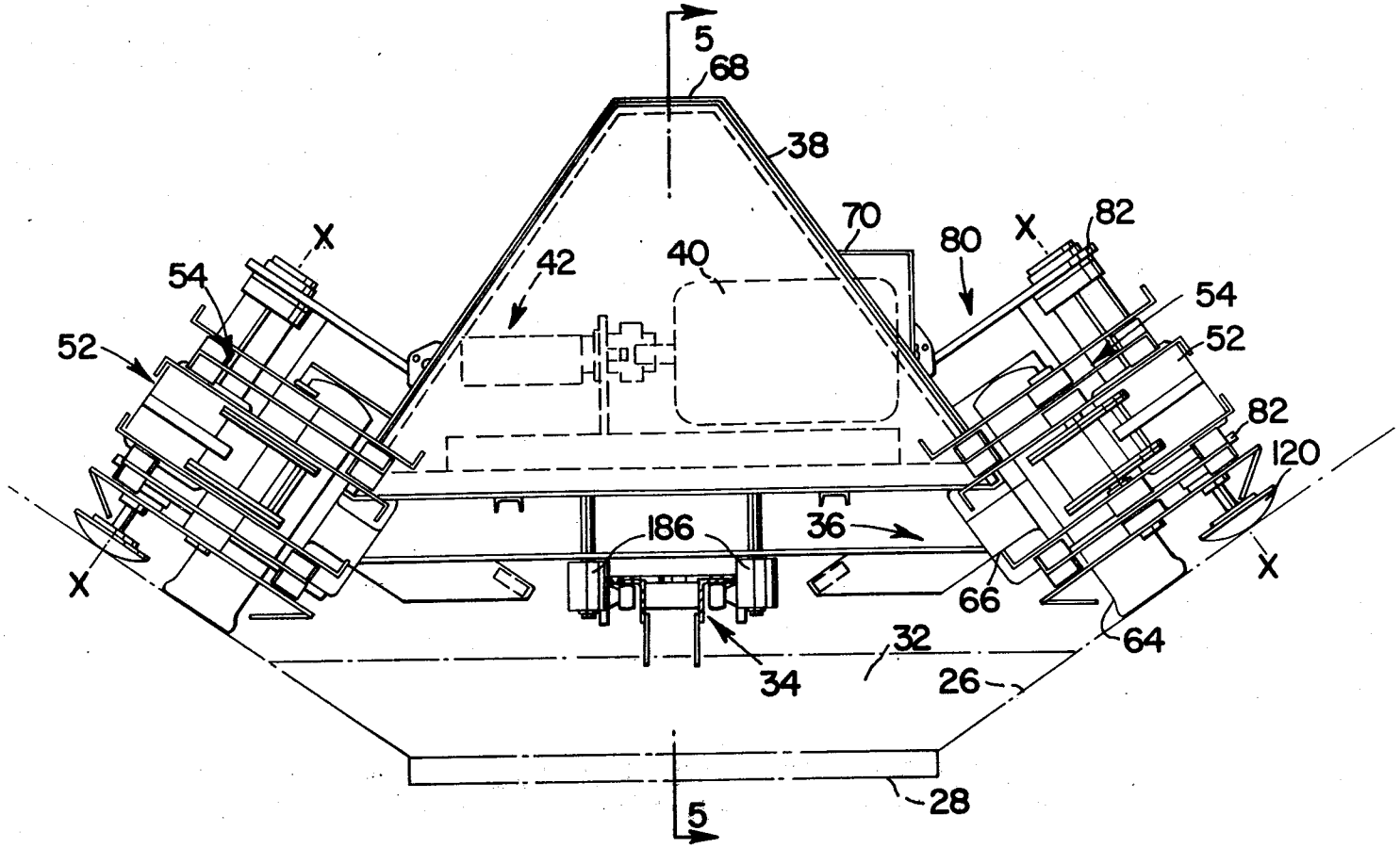
FIG. 4 is an end elevation view of the reclaimer and with the gear rack and track assembly shown in section.
Figure 5:
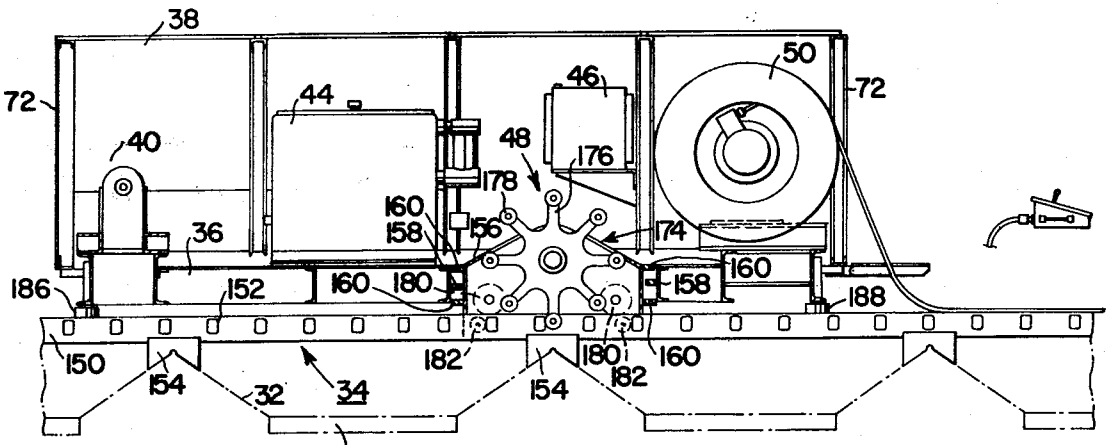
FIG. 5 is a longitudinal section view taken along line 5—5 in FIG. 4.

The reclaimer 20 includes a main frame 36 which is of steel welded construction adequately stiffened to reduce deflection under load. The frame 36 is of generally rectangular outline configuration as seen in plan and the various electrical and hydraulic components are situated on the bed of the frame 36 and are protected by means of a sturdy heavy gauge sheet metal shroud 38 which is best seen in FIGS. 3, 4 and 5. The bed of the reclaimer frame 36 serves to support, adjacent its forward end, an electric main drive motor 40, the latter being connected to a multi-section hydraulic pump 42. Also mounted on the frame are a reservoir tank 44 for hydraulic fluid and a cooler 46 for the hydraulic fluid (not shown in FIG. 1 but illustrated in FIG. 5); frame 36 also supports a powered cog drive assembly 48, and adjacent the rear portion of the frame a power cable take-up reel assembly 50.

Pivotally connected to opposing sides of frame 36 and in flanking relation thereto and extending forwardly of the frame are elongated arm assemblies 52 each of which carries a cutter head assembly 54 at its outer end. Also shown in FIG. 1 is a remote control console 60 which is connected to the reclaimer by means of a flexible umbilical cord 62 thus permitting the operator to stand a distance behind the reclaimer when the latter is in operation. However, as noted above, the control console and the operator's station may be mounted directly to the rear end of the reclaimer body.

The reclaimer 20 includes four wheels 64 which serve to rollingly support the reclaimer on the sloping side walls 26 of the hopper. The wheel mounting brackets 66 are so arranged in relation to the frame 36, that the wheels 64 are splayed outwardly on opposing sides of the reclaimer such that the wheels are disposed in planes which are substantially normal to the respective sloping side walls 26. This arrangement provides for greater stability of the reclaimer and provides for a better distribution of forces on the wheel bearings and on the pneumatic tires with which wheels 64 are provided.

The above noted shroud 38, as best seen in FIGS. 3, 4 and 5, is provided with a relatively narrow horizontal top wall 68, opposed downwardly and outwardly sloping side walls 70, and generally vertical end walls 72. The side and end walls 70, 72 are supported adjacent the periphery of the generally rectangular main frame 36. The side walls 70 of the shroud are provided with a plurality of access doors 74 each having hinges 76 adjacent their lower ends and latch means 78 at their upper ends whereby the individual doors 74 may be pivoted outwardly to enable inspection and repair of the various components mounted on main frame 36 to be effected. As a result of the downward and outward slope of the side walls 70 of the shroud, any material which falls downwardly on top of the reclaimer is caused to slide downwardly and outwardly with most of such material then falling onto the downwardly and inwardly sloping walls 26 of the hopper and thence through one or other of the discharge openings 28.

The arm assemblies 52, the cutter head assemblies 54, and the structures directly associated therewith will now be described with particular reference to FIGS. 3, 4, 6, 8, 9 and 10. Each arm assembly 52 is pivotally connected to the main frame 36 of the reclaimer by way of sturdy pivot support brackets 80. The pivot support brackets 80 are rigidly welded to main frame 36 at the opposing sides thereof and just forwardly of the rear wheels 64. Each pivot bracket 80 includes spaced apart outwardly extending upper and lower plate members 82, between which plate members the inner end of the associated arm assembly 52 is pivotally supported. The inner end of the arm assembly is provided with a sturdy pivot post 84 securely welded to the inner end of the arm assembly with the pivot support bracket 80, the pivot post 84, and the components associated therewith defining a pivot axis about which the arm assembly 52 and the associated cutter head 54 may swing. It should be noted that the pivot support bracket is so arranged in relation to the main frame 36 that the two pivot axes (designated by the letters X—X in FIG. 4) are inwardly inclined towards one another with each such pivot axis X—X being substantially normal to its associated inclined side wall 26 of the vessel hopper. By virtue of this arrangement, the associated arm assemblies 52 are capable of being swung in planes which are substantially parallel to the downwardly and inwardly sloping hopper walls 26.

Figures 8, 9, 10:
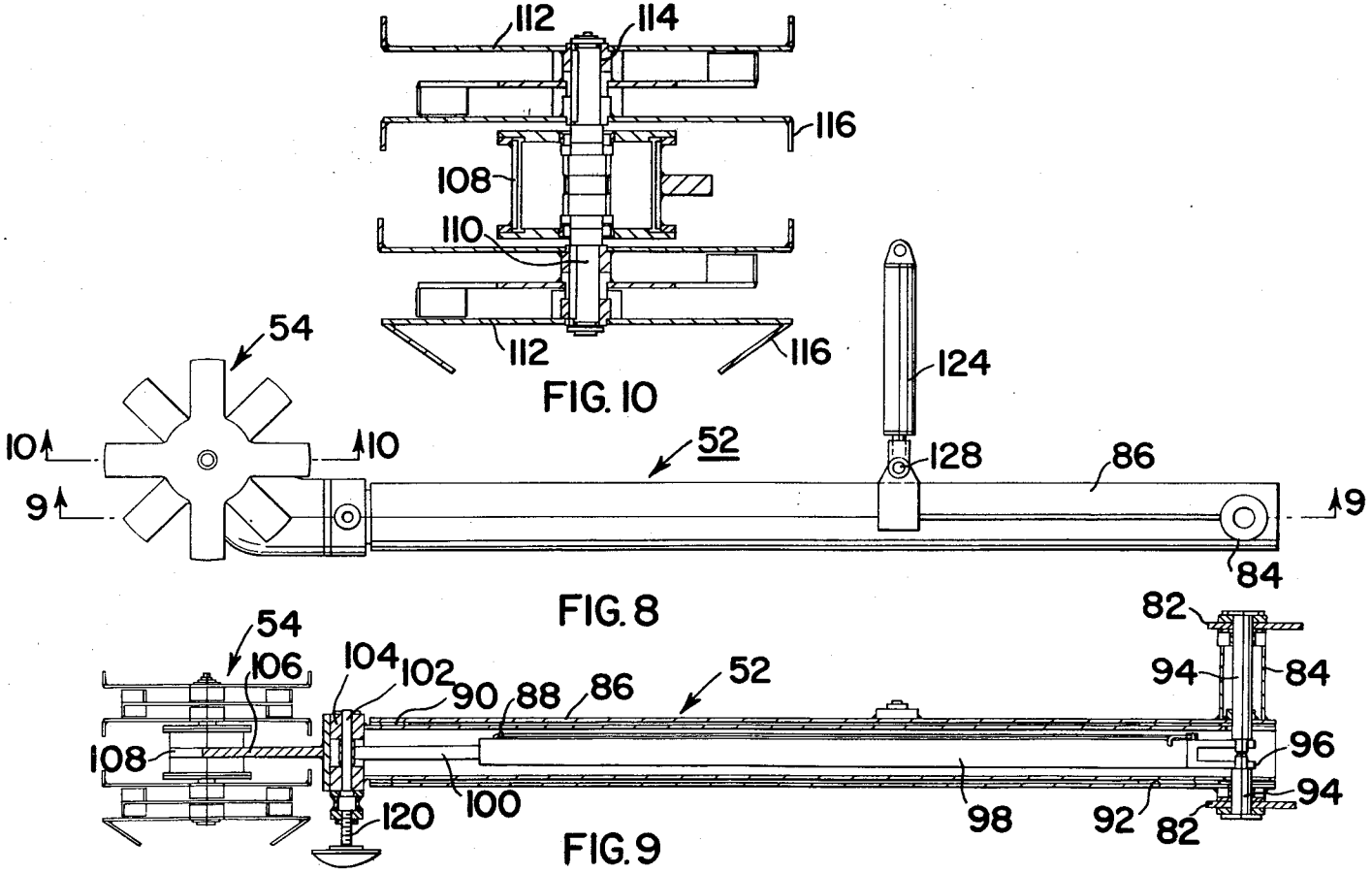
FIG. 8 is a plan view of the arm and cutter head assembly.
FIG. 9 is a longitudinal section of the arm and cutter head assembly taken along line 9—9 in FIG. 8.
FIG. 10 is a section view of the cutter head taken along line 10—10 and looking in the direction of the arrows.
Figure 12:
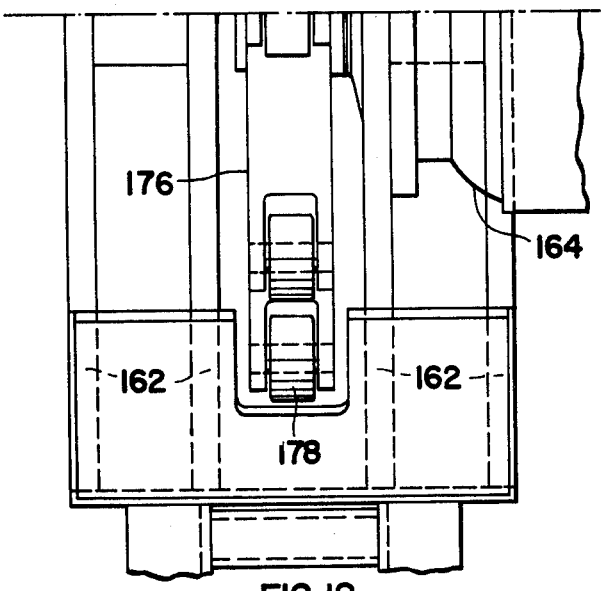
FIG. 12 is a partial plan view of the floating cog drive for the reclaimer.

With particular reference to FIG. 9, it will be seen that each arm assembly 52 includes an outer arm 86 and an inner arm 88 disposed within the outer arm and in telescoping sliding relationship therewith. Both the inner and outer arms 86 and 88 are preferably of tubular, generally rectangular-in-cross-section configuration. The outer arm is provided with nylon pads at 90 as seen in FIG. 9 while the inner arm is provided with similar nylon pads at 92. These nylon pads serve to reduce friction between the inner and outer arms and thus facilitate the telescoping motion of the inner arm 88 relative to the outer arm 86.

With continued reference to FIG. 9, it will be seen that the pivot post 84 is securely welded to the inner end of the outer arm 86. Pivot pin means 94 extend through suitable apertures provided in the upper and lower plate members 82 of the pivot support bracket with such pivot pin means 94 being bolted to their associated upper and lower plate members 82. The pivot post 84 is provided with suitable bearing means therein through which the pivot pin means 94 extend. The pivot pin means 94 are actually divided into upper and lower sections with the innermost ends of each being of a reduced diameter with these reduced diameter portions extending through a yoke element 96, the latter being rigidly connected to one end of an elongated hydraulic cylinder 98 disposed within the inner arm 88. A ram 100 extends out of the opposing end of the cylinder 98 and is connected to a pin 102 which extends through a cutter head mounting block 104, the latter being rigidly fastened to the outermost end of the inner arm 88.

The cutter head 54 is attached to the mounting block 104 via a sturdy steel plate 106, the outer end of plate 106 being welded to the casing of hydraulic motor 108. The hydraulic motor 108 may be, for example, a "Vickers" vane-type motor provided with a through-shaft 110. The cutter blade assemblies 112 are mounted on the upper and lower free ends of the through-shaft 110. Each cutter blade assembly includes a hub portion 114 keyed to through-shaft 110 with the hub 114 having the cutter blades welded thereto. The cutter blades are formed from relatively heavy sheet steel with each cutter blade assembly comprising a plurality of outwardly extending arm portions having off-set tip portions 116 formed thereon in any desired fashion as illustrated, for example, in FIGS. 8, 9 and 10. The precise configuration of the cutter blades is not particularly important; those skilled in the art will readily be able to provide cutter blade configurations which work best with the particular bulk material being handled. The blade configurations shown in the drawings were particularly suitable for use with relatively coarse bulk material such as coal.

In order to prevent the lowermost set of cutter blades 112 from coming into contact with the sloping walls 26 of the hopper during operation, each cutter head support block 104 is provided with a support pad assembly 120. Assembly 120 includes a nylon pad having a convex lower face so that it is capable of sliding over small bumps and obstructions on the sloping walls 26 of the hopper with such nylon pad being secured to the mounting block by a threaded stud 122 which permits adjustment of the nylon pad inwardly or outwardly relative to mounting block 104.

In order to effect movement of each arm assembly 52 and its associated cutter head assembly 54 about its associated pivot axis X—X, each arm assembly is provided with a suitable hydraulically actuated swing cylinder 124. The inner end of cylinder 124 is connected to the main frame 36 of the reclaimer via a mounting bracket 126 which includes suitable pivot means thereon while the ram of the hydraulic cylinder is connected via pivot means 128, including a yoke and bracket arrangement, to the outer arm 86. Thus, as the hydraulic cylinder 124 is extended and retracted, the arm assembly 52 is caused to swing about in a plane substantially parallel to the sloping hopper wall 26. The arc of movement of arm assembly 52 may be selected in accordance with requirements but generally such arc will not be required to exceed approximately 45°.

Figure 14:
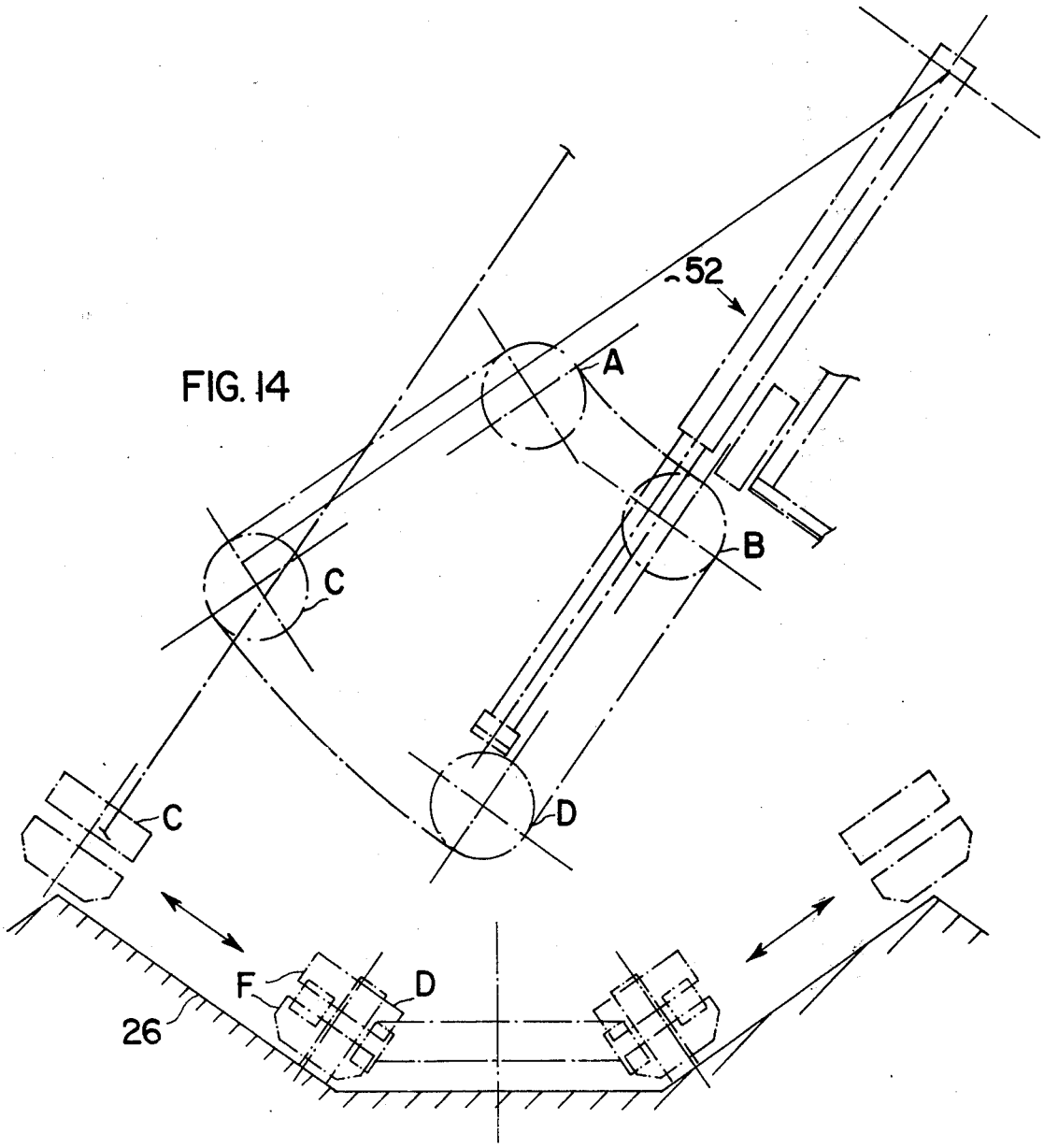
FIG. 14 is a layout of the cutter head and arm geometry.

With reference to FIG. 14 it will be seen that with the arm assembly 52 in the fully retracted position, that the cutter head assembly can be pivoted between the two positions depicted by reference characters A and B. When the arm assembly 52 is fully extended, the cutter head can be moved between the two positions depicted by reference characters C and D. Thus, by pivoting the arm assembly 52 by means of hydraulic actuator 124, and by extending or retracting arm assembly 52 as required, the cutter head assembly 54 can be made to traverse a very substantial area, as represented by the shaded area, without moving the reclaimer as a whole. With further reference to FIG. 14, the extreme positions of the cutter head assembly 54 are further depicted by the reference characters C and D in relation to the sloping hopper wall 26. The shaded areas F represent the width of the cut which the cutter head makes as it is moved in the fashion described above. This action is very effective in undercutting the bulk material and causing it to cascade along the sloping walls 26 and through the previously mentioned discharge openings 28.

Figure 6:
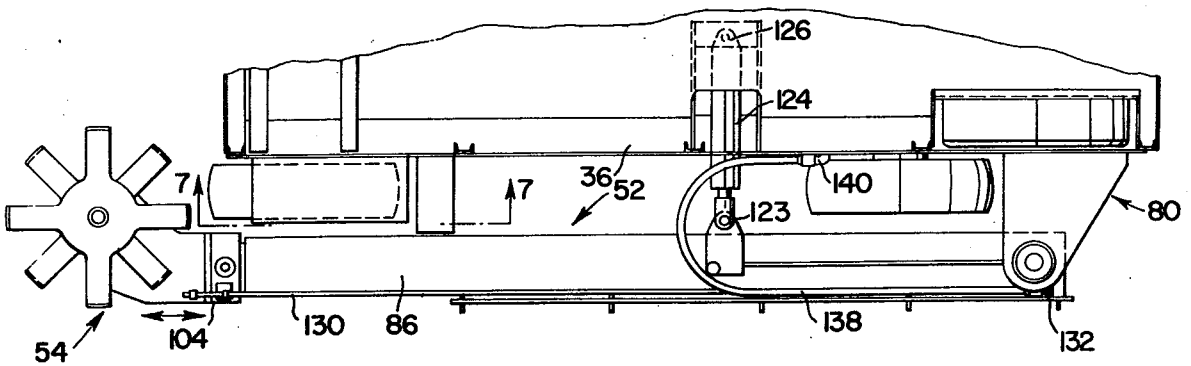
FIG. 6 is a partial plan section view of the reclaimer taken along line 6—6 in FIG. 3 and looking in the direction of the arrows.

The hydraulic fluid supply and return piping for the hydraulic motor 108 is best seen in FIGS. 3 and 6. Since arm assembly 52 can be extended and retracted, special means have to be provided in order to convey the hydraulic fluid to and from the hydraulic motor at all times. As seen in the drawings, the supply and return system includes rigid supply and return pipes 130 which extend rearwardly from the hydraulic motor 108 in parallel relationship to the arm assembly 52. The rearmost ends of these pipes 130 are connected to a manifold assembly 132. This manifold assembly is slidably supported on a rail 134, the latter being disposed above and rigidly secured to the outer arm 86 by means of spaced brackets 136. Thus, as the arm assembly 52 is extended and retracted, the hydraulic motor 108 and the attached hydraulic fluid pipes 130 are moved back and forth relative to the outer arm 86 while at the same time the manifold assembly 132 moves back and forth corresponding distances along the support rail 134. In order to transmit the hydraulic fluid from the manifold assembly 132 to the hydraulic piping mounted to the reclaimer 36, flexible tubes 138 are provided, such flexible tubes being interconnected in suitable fashion between manifold 132 and the pipe elbows 140 which are secured to the reclaimer frame. These flexible tubes 138 are arranged to form a U-shape bight as best seen in FIG. 6. Thus, as the arm assembly 52 is extended and retracted, with the manifold 132 being moved back and forth along support rail 134, the opposing legs of the U-shaped bight of flexible tubing 138 are extended or shortened relative to one another as the case may be. In place of the above described arrangement, a telescoping tube hydraulic piping connection may be provided to accommodate extension and retraction of the arm assembly 52.

The means for effecting movement of the reclaimer longitudinally of the vessel hopper will now be described with particular reference to FIGS. 4, 5, 11, 12 and 13.

As noted previously, the vessel hopper is provided with an elongated track and rack arrangement 34 and extending substantially the full length of the ship's hold. The track and rack assembly 34 includes a spaced apart pair of elongated rails 150 of inverted L-shaped configuration with the horizontally extending legs of the L-portions being directed outwardly and away from one another. These rails 150 are secured in their spaced apart relationship by means of a series of short pieces of tubing 152 each of the latter being generally of rectangular cross-section. The opposing ends of the short tubes 152 are securely welded to their associated rails 150 in equally spaced relationship as best seen in FIG. 5. The entire rack and track assembly 34 is supported above the transverse sections 32 by means of a series of support brackets 154 the latter being securely welded to both sections 32 and the elongated rails 150.

The above noted cog drive assembly 48 includes a sub-frame 156 which is mounted in a suitably dimensioned recess provided in main frame 36 of the reclaimer at the longitudinal center line thereof and forwardly of the cable reel arrangement 50 as best seen in FIG. 5. This entire sub-frame 156 and the assemblies associated therewith are free to move upwardly and downwardly relative to the main frame 36 by a substantial amount with such degree of relative vertical motion being limited only by key plates 158 welded to main frame 36 and vertically spaced apart stop plates 160 welded to the opposing ends of sub-frame 156 also as seen in FIG. 5.

The sub-frame 156 includes a series of heavy steel plates 162 rigidly welded together and providing a support for a gear reduction unit 164 which is operatively connected to a hydraulic drive motor 166 via a hydraulically actuated "fail-safe" brake assembly 168 and a right angle gear box unit 170. The brake assembly 168 may, for example, comprise an "Ausco" brake having an internal spring arrangement which causes the brake to be applied in the event of loss of hydraulic pressure thus preventing movement of the reclaimer along the rack and track assembly in the event of hydraulic system failure. This brake is also used to hold the reclaimer in position on the track assembly when the arm assemblies 52 are extended into a wall of coal, for example, which action would otherwise move the reclaimer rearwardly. The hydraulic motor may be of any well known commercially available variety as may the gear reduction unit 164 (a "Brevini" reducer was found to be very satisfactory for this purpose).

The output shaft 172 of the reducer unit 164 is rigidly keyed to a cog wheel assembly 174. The cog wheel assembly includes a hub portion having a plurality of arms 176 extending radially outwardly therefrom with each arm bearing a roller element 178 at its outermost extremity. In operation, these roller elements 178 contact the respective transversely extending pipe sections 152 as the cog wheel 174 is driven in rotation thus effecting movement of the reclaimer along the rack and track assembly 34.

Figure 11:
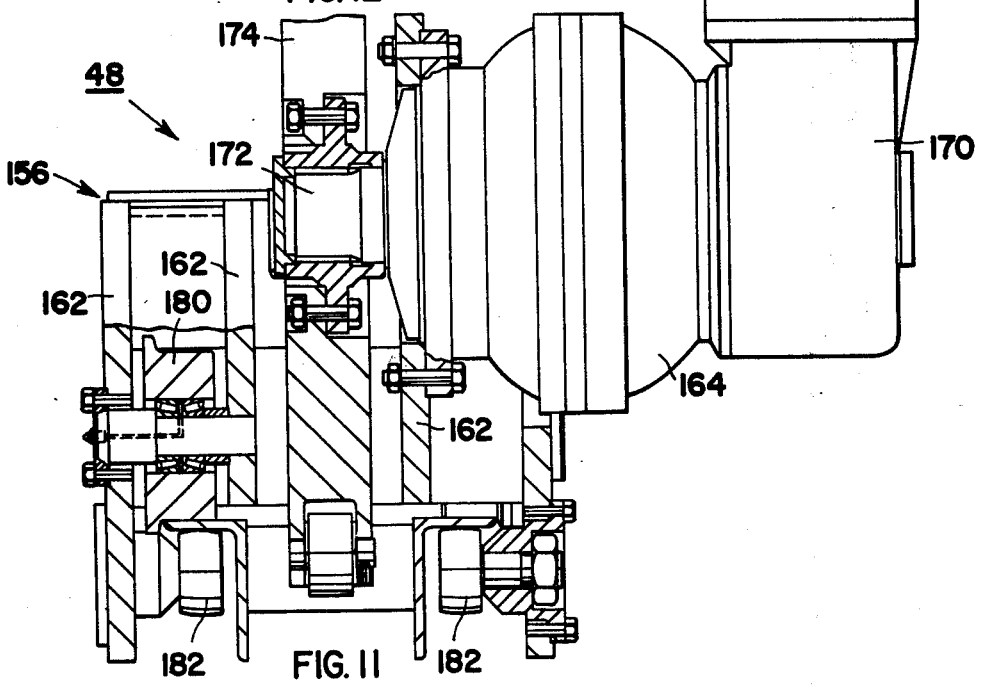
FIG. 11 is an end elevation view of the floating cog drive for the reclaimer.
Figure 13:
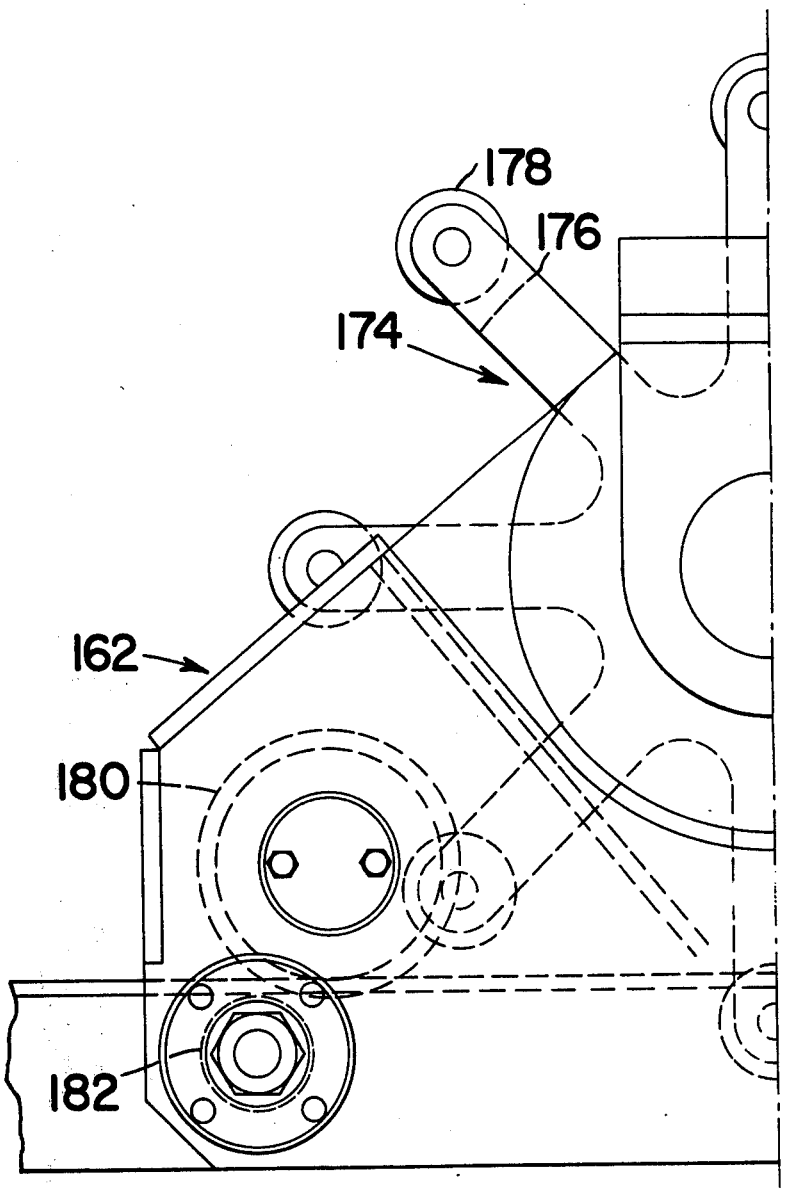
FIG. 13 is a partial side elevation view of the floating cog drive for the reclaimer.

The sub-frame 156 is rollingly supported on the spaced apart rails 150 by means of four steel rollers 180 such rollers 180 having flanges thereon whereby to positively guide the drive assembly 48 along the track and rack assembly 34. In order to prevent upward movement of the drive assembly 48 relative to the track and rack assembly, the sub-frame 156 is provided with four spaced apart lower rolls 182, which rolls engage the undersurfaces of the horizontally directed portions of rails 150 (as best seen in FIGS. 4 and 11) thereby preventing upward movement of sub-frame 156 and thus preventing disengagement of the cog wheel 174 from the track and rack assembly. Thus, by virtue of the above described arrangement, a positive drive for the reclaimer back and forth along the bottom of the hopper is assured. In the event that one or more of the wheels 64 of the reclaimer pass over any obstructions such as lumps of the bulk material which may have adhered to the sloping walls 26 of the hopper reclaimer frame 36 is merely lifted upwardly, while the sub-frame 156 remains in the same position. Thus, the relationship between the drive assembly 48 and the rack and track assembly 34 is not disturbed.

In order to positively guide the reclaimer 20 along the rack and track assembly 34 and to maintain the two in substantial parallelism at all times, the front and rear end portions of main frame 36 are provided with pairs of downwardly extending main guide rolls 186 and 188 as best seen in FIGS. 4 and 5. These guide rolls are mounted in spaced apart relationship with their axes vertically oriented and in flanking relation to the spaced apart rails 150 of the rack and track assembly 34. In the event that the reclaimer tends to deviate from a straight line path during movement, one or other of the rolls of the two pairs 186, 188 will come into engagement with the above noted rails 150 thereby to correct the situation.

Figure 7:
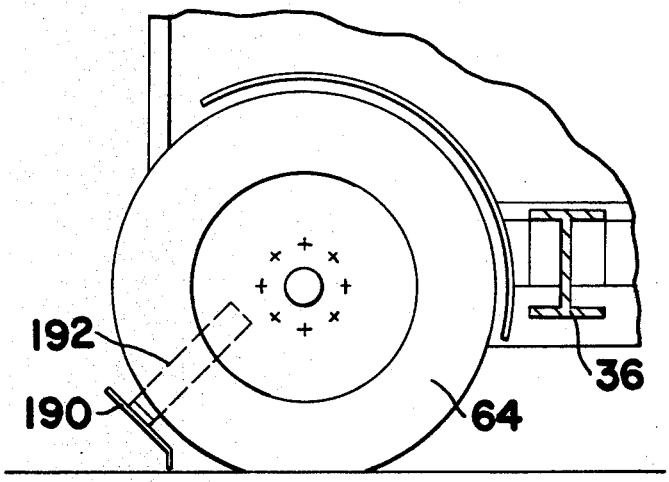
FIG. 7 is a section view taken along line 7—7 in FIG. 6 and looking in the direction of the arrows.

It should also be mentioned at this point that it is desirable to provide all of the wheels 64 of the reclaimer with small scraper blades located in front of and behind each wheel thereby to remove accumulations of debris from the sloping hopper walls 26 before the wheels 64 have an opportunity to pass thereover. One such arrangement is illustrated in FIG. 7 where it will be seen that a scraper blade 190 is provided just forwardly of wheel 64 with such blade 190 being connected to main frame 36 by way of a support arm 192. A similar support is used for a blade (not shown) behind the wheel. Further details of this blade need not be given at this point since those skilled in the art will readily be able to provide suitable devices for this purpose.

The hydraulic and electrical control systems for the reclaimer will now be described with reference to FIGS. 15 and 16.

Figure 15:
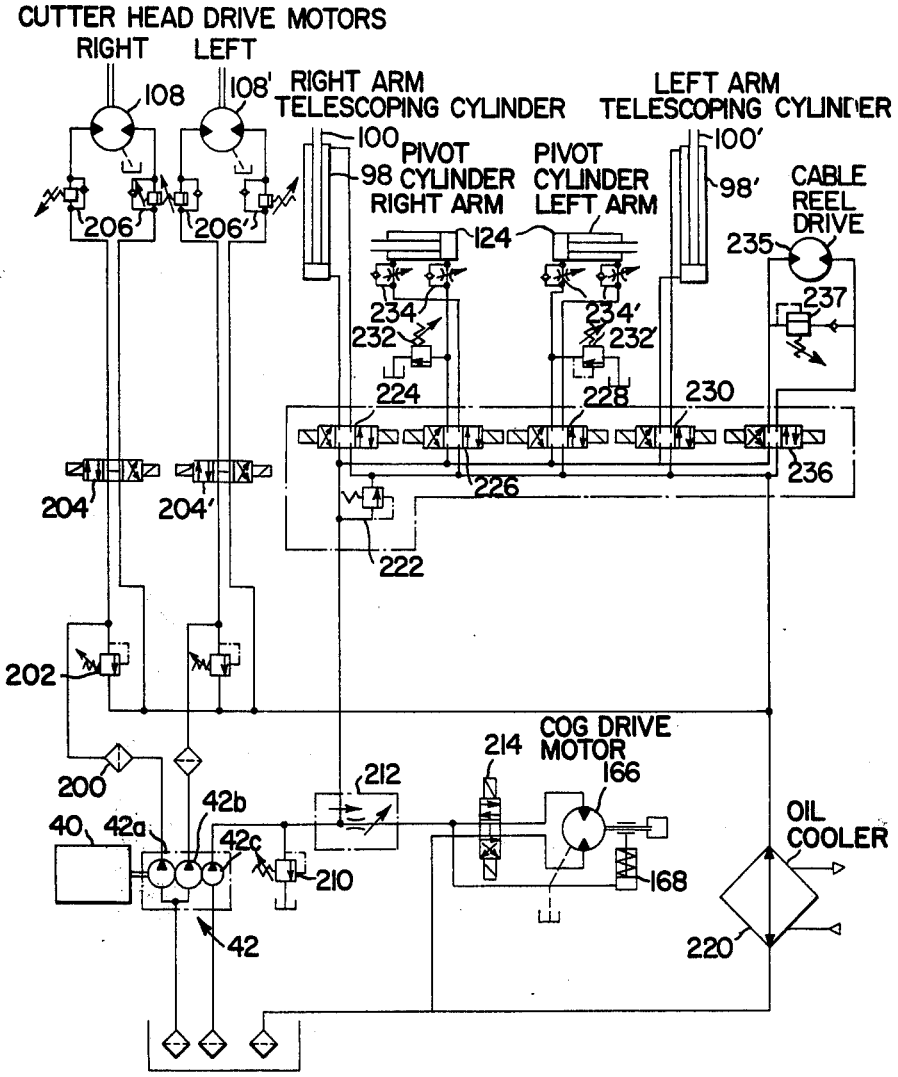
FIG. 15 is a schematic diagram of the hydraulic system for actuating the several components of the reclaimer.

With reference to FIG. 15 which shows the hydraulic system and associated components in schematic form, it will be seen that the main drive motor 40 is connected to the hydraulic pump assembly 42 which assembly comprises three hydraulic pumps **42*a*, 42*b* and 42*c*. Pumps 42*a* and 42*b* are connected to separate hydraulic circuits which supply hydraulic fluid to each of the two hydraulic motors 108 mounted to the previously described arm assemblies 52. Since both circuits are identical, and since they employ standard components only a brief description of each is necessary. Considering the hydraulic circuit supplied by pump 42*a*, it will be seen that there is provided a strainer 200 and a main relief valve 202 which is preset at the desired relief pressure. A four-way three position solenoid actuated valve 204 is connected in the supply and return lines for the hydraulic motor 108 as are a pair of counter-balancing valves 206, the latter being also preset at the desired pressures. By virtue of the four-way three position valves 204**, each of the two hydraulic motors may be stopped and started and driven in either direction according to the will of the operator.

The remaining hydraulic pump 42c supplies hydraulic fluid for actuating the hydraulic cog drive motor 166 and also for actuating the hydraulic cylinders 98 which effect retraction or extension of arms assemblies 52 and also actuate the hydraulic cylinders 124 which effect pivotal motion of the arm assemblies 52 and their associated cutter heads 54 as described previously.

The hydraulic circuit connected to pump 42c includes a main relief valve 210, and a proportional divider 212 which proportions the flow going to the hydraulic motor 166 and the several hydraulic cylinders referred to above. The circuit portion supplying hydraulic motor 166 includes a four-way three position valve 214 which is solenoid actuated thereby enabling the cog drive hydraulic motor 166 to be stopped and started and driven in either the forward or the reverse directions according to the will of the operator. The previously referred to hydraulically actuated safety brake 168 is also connected in the hydraulic circuit as shown in FIG. 15. When hydraulic pressure is available, the brake 168 is held in the "off" position. However, in the event of hydraulic system failure, the spring overcomes the remaining hydraulic pressure and actuates the brake thus preventing movement of the gear train connected to the hydraulic motor.

It should also be noted that an oil cooler 220 is also connected in the return line from the hydraulic motors 108 thereby to maintain the hydraulic fluids at a suitable operating temperature.

The hydraulic circuit portion supplying the pairs of hydraulic cylinders 98 and 124 is provided with a relief valve 222 with each individual cylinder 98, and 124 being provided with a respective four-way three position valve 224, 226, 228 and 230, all of these valves being solenoid actuated. Thus, each of the pairs of cylinders 98, 124 may be individually controlled by the operator. The hydraulic circuit portion supplying the two hydraulic cylinders 124 is also provided with auxiliary relief valves 232 and flow control valves 234 for reasons which will be readily apparent to those skilled in the art.

The cable reel assembly 50 is also provided with a take-up motor 235 which is controlled by a four-way three position solenoid valve 236. Adjustable relief valve 237 enables the maximum pull exerted on the cable by reel assembly 50 to be varied as described. The hydraulic system of the cable reel drive is typically designed to exert a line pull of approximately 100 lbs. on the electrical cable.

The system is similar to a "control tension" winch, i.e. the cable reel 50 "pulls in" with a force of 100 lbs. when the reclaimer is moving backwards thus winding cable onto the reel 50 and "holds back" with a force of 100 lbs. when the reclaimer is moving forwardly thus allowing cable to be pulled off the reel. In the "pull in" mode of operation the hydraulic motor 235 is acting as a "motor" supplying power to the cable reel drive. In the "hold back" mode of operation the hydraulic motor is acting as a "pump" or braking means absorbing a force of 100 lbs. The electric solenoid hydraulic valve 236 is energized in the same direction whenever the cog drive motor 166 is signalled to go either forward or reverse. The solenoid valve however is provided such that the cable reel 50 can be powered in the opposite direction for maintenance purposes.

Figure 16:
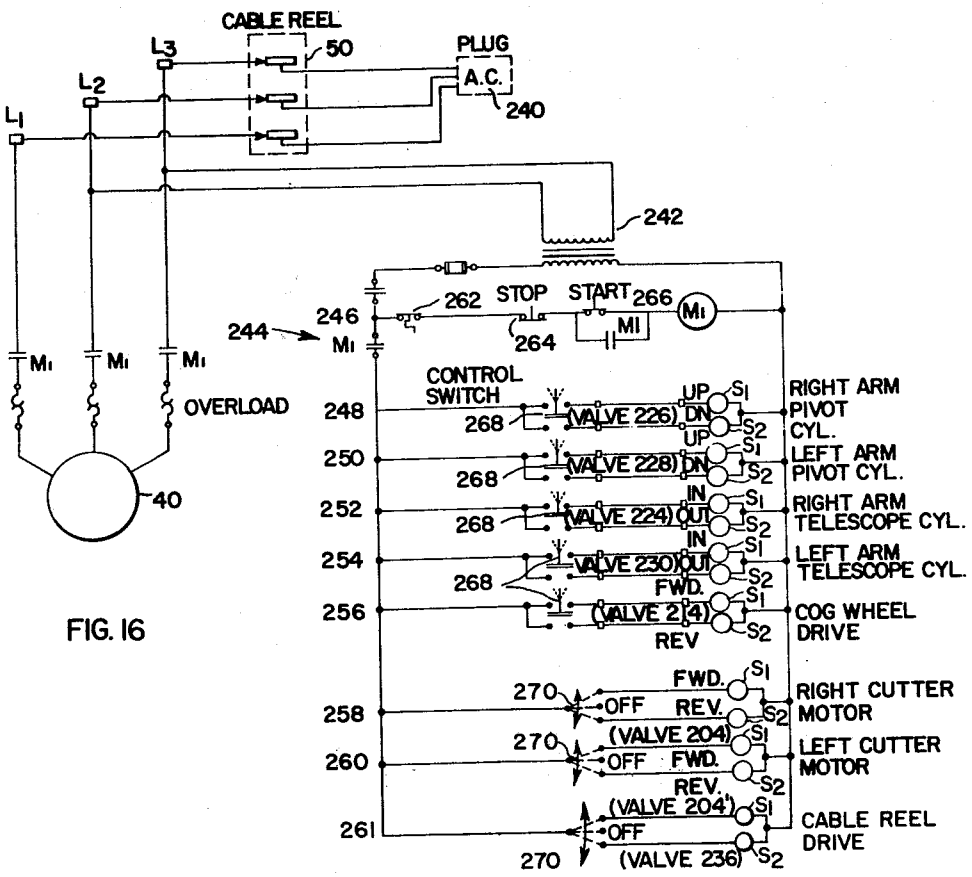
FIG. 16 is a schematic diagram of the electrical motor drive circuit and the control circuits for the reclaimer.

With reference to FIG. 16, the electrical circuitry commences at a source 240 of alternating current power electrical power being conveyed by a power supply cable to the cable reel assembly 50. The latter employs a conventional slip-ring arrangement therein to permit the cable reel to be rotated while supplying power continuously to power lines L1, L2 and L3 which supply the three phase electrical main drive motor 40. Each of the lines L1, L2 and L3 includes contacts M1 therein as well as suitable overload protectors.

Lines L2 and L3 are connected to the input side of a transformer 242 which provides current at a reduced voltage to the control circuit broadly indicated by reference 244. This control circuit contains therein the circuit branches 246 through 260. Circuit branch 246 comprises the circuit for controlling the starting and stopping of motor 40 and includes therein a conventional temperature responsive overload switch 262, stop and start switches 264 and 266 respectively with the usual relay contacts M1 in parallel with the start switch 266 and solenoid M-1 for actuating the relay contacts M1 in lines L1, L2 and L3.

Circuit branches 248 through 256 are all essentially identical in nature with each of them employing a control switch 268 of the momentary contact variety which enables the operator to selectively energize either one of the solenoids S1 or S2. Branch circuit 248, for example, effects control of solenoid operated valve 226 which controls the operation of cylinder 124, which effects pivoting of the right arm assembly 52 and its associated cutter head. Circuit branch 250 operates in similar fashion to control solenoid valve 228 which controls the pivoting of the left arm assembly 52. Branch circuits 252 and 254 control the operation of solenoid valves 224 and 230 respectively, such valves serving to actuate the cylinders 124 which serve to effect extension and retraction (i.e. telescoping motion) of the right and left respectively arm assemblies 52. Circuit branch 256 controls solenoid valve 214 which in turn controls the operation of the hydraulic motor 166 which effects actuation of the cog drive assembly 48.

Circuit branches 258 to 261 are very similar to the circuit branches noted above except that they employ three position switches 270 as opposed to the momentary contact type of switches used in the circuits noted above. Circuit branches 258 and 260 serve to control the operation of solenoid valves 204 and 204' respectively which valves, in turn, control the operation of the right and left hand cutter head drive motors 108, while circuit branch 261 controls the operation of the cable reel take-up motor 235.

The stop-start switches 264 and 266 as well as the various control switches 268 and 270 are all conveniently mounted on the operator's control console referred to previously. The remaining circuit components are mounted in a suitable fashion to the main frame 36 of the reclaimer.

Those skilled in the art will realize that the overall size of the reclaimer and the various components associated therewith may be varied considerably. However, by way of general information, a typical embodiment constructed as described herein had an approximate overall length of sixteen feet, an approximate overall width of twelve feet, and an approximate overall height of five feet, all of the above dimensions being taken with the reclaimer in the "storage position" with the arm assemblies 52 located in parallelism with the longitudinal axis of the reclaimer and in the retracted position.

The cog drive assembly 48 was arranged to provide the reclaimer with a travel speed of approximately fifty feet per minute and was capable of providing an intermittent pull-out force on the reclaimer of approximately ten thousand pounds which was sufficient to move the reclaimer out from beneath an avalanche of coal. The cutter heads were driven in rotation by their cutter head motors at a speed of about one hundred revolutions per minute and the maximum stall torque at the cutter head motor output shaft was in the order of twenty thousand, inch-pounds. The cutter head blade diameter was approximately thirty inches and the arm assemblies 52 were capable of pivoting through an arc of approximately 45°. Both arm assemblies 52 were capable of being extended up to about eight feet from their retracted positions. The main drive motor was capable of developing approximately one hundred horsepower.

We claim:

1. In a combination, an elongated hopper having downwardly and inwardly sloping side walls, said hopper having elongated discharge openings at its bottom, and conveyor means located below the discharge openings for conveying away bulk material discharging through said openings, and a reclaimer supported entirely within and movable longitudinally of said hopper along said side walls adjacent the bottom of said hopper and above said discharge openings, said reclaimer having a body portion attached to a plurality of wheels which engage with an inner material containing surface of said side walls to support said reclaimer in said hopper and at least one arm pivotably mounted on said body portion, the pivot axis of said arm being normal to a respective adjacent side wall of said hopper such that said arm is constrained to pivot in a plane substantially parallel to a respective side wall, a cutter means disposed on the end of said arm for undercutting said bulk material in said hopper and to cause the same to cascade downwardly along said respective sloping side wall and through the elongated discharge openings.

2. The combination according to claim 1 wherein a pair of arms each provided with a cutter means at its end are disposed on opposite sides of said body portion, each arm having a pivot axis normal to a respective opposite side wall of said hopper, and each arm being constrained to pivot in a plane substantially parallel to said respective side wall.

3. The combination according to claim 2 wherein said reclaimer includes an actuator means for pivoting said arms, said arms also being extensible with further actuator means for extending and retracting the arms, whereby to enable said cutter elements to traverse substantial areas in said planes parallel to said sloping side walls.

4. The combination according to claim 3 wherein said reclaimer includes drive means provided on said body portion for moving the reclaimer longitudinally of said hopper, said hopper including means extending longitudinally thereof for cooperating with the drive means to positively move the reclaimer.

5. The combination according to claim 4 wherein said means extending longitudinally of the hopper comprises a gear rack disposed longitudinally in said hopper and said drive means comprises a powered cog gear mounted on said body portion of said reclaimer cooperating with said rack to positively move said reclaimer.

6. The combination according to claim 5 further comprising vertical displacement means mounting said powered cog gear to said body portion for allowing said powered cog gear to freely move vertically relative to the remainder of the body portion of the reclaimer whereby to eliminate disengagement of the cog gear from said gear rack in the event said reclaimer is lifted upwardly momentarily by virtue of said wheels travelling over any bulk material contained on the sloping side walls of the hopper.

7. Reclaimer apparatus adapted to be positioned in an elongated bulk material containing hopper or cargo hold of the type having opposed side walls which slope downwardly and inwardly toward the hopper bottom, the latter having a series of longitudinally extending discharge openings therein for discharging the bulk material on to a conveyor running lengthwise of the hopper, said reclaimer apparatus comprising a generally rigid frame adapted to be located entirely within the hopper above said discharge openings, a plurality of wheels mounted to said frame and engaging with the inner material containing surface of said side walls to support said reclaimer, drive means for moving said frame along the hopper bottom, the reclaimer further including at least one arm pivotably coupled to said frame with the pivot axis of said arm being normal to a said side wall, said arm being constrained to be movable in a plane lying generally parallel to and adjacent a respective sloping side wall, cutter means mounted on the end of said arm adapted to cut through said bulk material in such a way as to undercut the bulk material and to cause same to cascade downwardly and along a side wall and through the discharge openings, said cutter means comprising rotatable cutter elements mounted on end portions of said arm for undercutting said bulk material.

8. Reclaimer apparatus according to claim 7 wherein a pair of said arms are provided in flanking relation to said frame means and extending generally forwardly of the frame means with each said arm being pivotally mounted thereto so that its pivot axis is normal to a respective side wall, said apparatus including an actuator means for pivoting said arms, said arms also being extensible with further actuator means for extending and retracting said arms, each arm being provided with cutter elements on its end whereby to enable said cutter elements to traverse substantial areas in said planes parallel to said sloping side walls.

9. Reclaimer apparatus according to claim 8 wherein said means for moving the reclaimer along the hopper bottom includes motor means mounted to said frame means.

10. Reclaimer apparatus according to claim 7 wherein the drive means includes a powered cog gear mounted on said frame adapted to cooperate with rack and track assembly connected to and extending longitudinally of the hopper bottom to positively move the reclaimer.

11. Reclaimer apparatus according to claim 10 further comprising vertical displacement means mounting said powered cog gear to said frame means for allowing said powered cog gear to freely move vertically relative to said frame whereby to eliminate disengagement of the cog gear from said rack and track assembly in the event said reclaimer is lifted upwardly momentarily by virtue of its wheels travelling over any bulk material contained on the sloping side walls of the hopper.

12. Reclaimer apparatus according to claim 11 wherein said vertical displacement means includes a sub-frame having said cog gear mounted thereto, and wherein a motor operatively connected to said cog gear, said frame of the reclaimer having a recess therein and said sub-frame being mounted in said recess and being vertically movable relative thereto, and roller means mounted to said sub-frame and adapted to engage said rack and track means to prevent vertical motion of the sub-frame and disengagement of said cog gear from the rack and track assembly.

13. Reclaimer apparatus according to claim 12 wherein said motor is a hydraulic motor, and said apparatus further comprises brake means responsive to the pressure of the hydraulic fluid supplied to said motor and operatively connected to the cog gear for preventing rotation of same in the event of a loss of hydraulic fluid pressure.

14. Reclaimer apparatus according to claim 10 including guide rolls mounted to said reclaimer frame for guiding said frame along the rack and track assembly in substantial parallelism therewith.

15. Reclaimer apparatus according to claim 7 including a metal shroud disposed over said reclaimer frame and having downwardly and outwardly sloping wall portions thereon for deflecting falling bulk material off to the lateral sides of the reclaimer and to protect operating machinery mounted to said frame.

16. Reclaimer apparatus according to claim 7 wherein said wheels are splayed outwardly on opposing sides of the reclaimer frame so as to lie in planes generally normal to the sloping walls of the hopper thereby to provide for stability and more even distribution of stresses on the wheels.

17. Reclaimer apparatus according to claim 8 wherein each of said arm means includes an outer arm and an inner arm, the latter being arranged in telescoping sliding relation to the former, and said further actuator means comprising an elongated hydraulic actuator disposed in said arm means for effecting extension and retraction of the arm means.

18. Reclaimer apparatus according to claim 17 wherein the cutter means is mounted to an outer end portion of the inner arm, the cutter means comprising a hydraulic motor and the cutter elements comprising cutter blade assemblies connected to said motor for rotation therewith, and hydraulic control means for controlling the operation of said last mentioned hydraulic motor.

19. Reclaimer apparatus according to claim 18 including a support pad assembly connected to each arm means to prevent direct contact between the cutter blade assemblies and the sloping walls of said hopper.

20. Reclaimer apparatus according to claim 18 whrein the hydraulic motor and said control means therefor are adapted to permit said motor to be driven in either direction of rotation.

* * * * *